United States Patent [19]

Hess

[11] 4,427,191

[45] Jan. 24, 1984

[54] PANEL CLAMP

[76] Inventor: Stanley E. Hess, 320 W. Fourth St., Ashland, Ohio 44805

[21] Appl. No.: 391,493

[22] Filed: Jun. 24, 1982

[51] Int. Cl.[3] ..... B25B 1/20

[52] U.S. Cl. ..... 269/43; 269/128; 269/287; 269/221

[58] Field of Search ..... 269/287, 43, 88, 221–223, 269/219, 126–129, 111, 113, 114, 152; 24/263 A; 224/917, 315; 100/289, 290; 211/605 K; 156/304.1, 560; 38/102.1; 280/814, 815

[56] References Cited

U.S. PATENT DOCUMENTS

| | | | |
|---|---|---|---|
| 1,847,473 | 3/1932 | De Right | 269/128 |
| 2,525,204 | 10/1950 | Calabro | 269/287 |
| 2,560,902 | 7/1951 | Smith | 269/287 |
| 2,928,443 | 3/1960 | Sevachko | 269/287 |
| 2,993,254 | 7/1961 | Larson | 24/263 A |
| 3,393,718 | 7/1968 | King | 269/128 |
| 3,443,831 | 5/1969 | Grange | 24/263 A |
| 4,046,362 | 9/1977 | Spillers | 269/43 |
| 4,074,897 | 2/1978 | Behn | 269/128 |
| 4,129,393 | 12/1978 | Sickler | 24/263 A |
| 4,289,305 | 9/1982 | Penner | 269/43 |
| 4,291,868 | 9/1981 | Giles | 269/152 |

FOREIGN PATENT DOCUMENTS 4639 of 1879 United Kingdom ..... 269/287

OTHER PUBLICATIONS

Condensed Catalog No. L-20 of The Adjustable Clamp Company.

*Primary Examiner*—Robert C. Watson

*Attorney, Agent, or Firm*—Squire, Sanders & Dempsey

[57] ABSTRACT

A panel clamp for preventing warping of a panel formed from edge-glued boards during gluing of said boards, including two-ended opposing jaw members for maintaining the boards in lateral registration, adjustment means at the end of each jaw member for adjusting the separation of the jaws and release means for quickly releasing and assembling the clamp.

7 Claims, 5 Drawing Figures

PANEL CLAMP

BACKGROUND OF THE INVENTION

This invention relates to clamping boards, particularly wooden boards, which are being glued edge-to-edge to form a panel. Such panels are commonly prepared by cabinetmakers in the course of building furniture such as case goods, table tops, cabinet panels and by carpenters in the course of building and remodeling homes. The usual procedures in constructing such panels begins with planing of all the boards for a panel to the same thickness. The boards are also planed on their edges. Glue is applied to the edges and the boards are clamped transversely, i.e., across their grain, to squeeze the glued edges together while the glue cures. Conventional clamps are available for this transverse clamping.

In spite of careful attempts (e.g., staggering transverse clamps above and below the panels) to avoid buckling, warping or cupping of the panel induced by the transverse clamping force, typically, the finished, glued panels are not flat. Because the panels are generally wide, they cannot be planed flat in conventionally available planers. Moreover, planing a warped panel undesirably reduces the panel's thickness and exposes different wood grains and the glue joints. In large quantity production shops, an attempt is made to prevent warping by stacking the gluing panels on top of each other and weighting or compressing the stack with a heavy, stationary press. But I am not aware of any clamp suitable for use in small-quantity production shop, at on-site jobs or in home workshops which deals with the problem of panel warping during gluing.

The present invention provides a simple, easy-to-use, inexpensive and portable panel clamp which prevents warping of a panel during the gluing of boards to form the panel without interfering with the transverse clamping of the glue joints. The invention is described with reference to a preferred embodiment which is depicted in the figures of the drawings.

DETAILED DESCRIPTION OF PREFERRED EMBODIMENT

Figure 1:
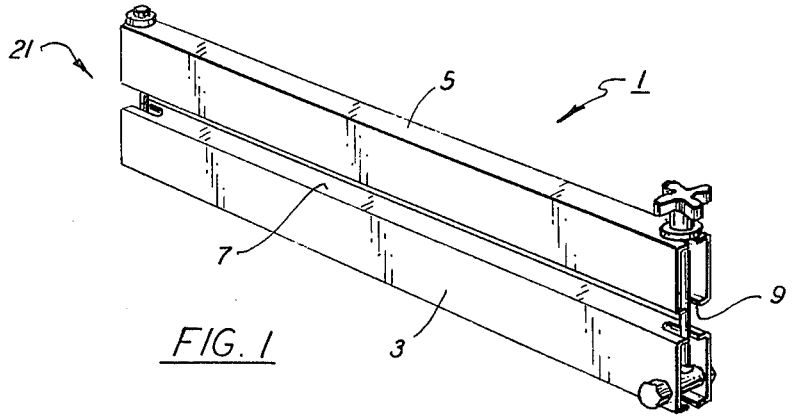
FIG. 1 is a perspective view of an embodiment of panel clamp according to the invention.

In FIG. 1, a perspective view of a perspective embodiment of a panel clamp 1 according to the invention is shown. Two opposing jaw means for maintaining boards in lateral registration during transverse gluing are shown. Throughout this description it is assumed that the inventive clamp is used with boards being glued along their edges, i.e., that the boards are rectangular parallelepipeds having two ends, two broad surfaces and two narrow surfaces, the latter being designated edges to which glue is applied. The grain of the wood is assumed, for purposes of description, to run along the long dimension, i.e., the length, of the boards. Therefore, a transverse dimension or force is one which is cross-grain. Likewise, for description, the boards are each assumed to have a uniform thickness measured in a lateral direction, i.e., along a direction normal to and extending from one broad surface of a board to its other broad surface. Therefore, the term lateral registration as used in this description refers to aligning the thicknesses of boards for a panel so that the broad surfaces of the boards form two, opposing generally planar panel surfaces free from warping or buckling.

Returning to FIG. 1, the opposing jaw means are shown in the form of cylindrical jaw members 3 and 5 for bearing on the boards being glued. I prefer to construct the jaw members from tubing of rectangular cross section so that the jaws which bear on the boards are formed by opposing planar surfaces 7 and 9. This construction is preferred so that the jaws have a substantial area which bears upon the broad surfaces of the boards to maintain lateral registration without damaging those surfaces. However, the invention is by no means limited to the use of planar jaws. Tubes, such as pipes of circular cross section, or rods of nearly any cross section could be substituted for rectangular tubular cylinders 3 and 5. An important characteristic of a jaw means is its resistance to bending between its ends, i.e., along its longitudinal axis. The preferred rectangular tubing provides good resistance to longitudinal bending moments.

The material from which the jaw members are constructed preferably is easily cleaned of glue residue and does not rust. I have found that chrome steel alloy performs well and that wood glues do not adhere strongly to it. Alternatively, the jaws, i.e., the surfaces of the jaw members bearing on the boards, could be covered with a protective laminate or other glossy surface material which does not rust and is easily cleaned of glue residue.

Figure 2:
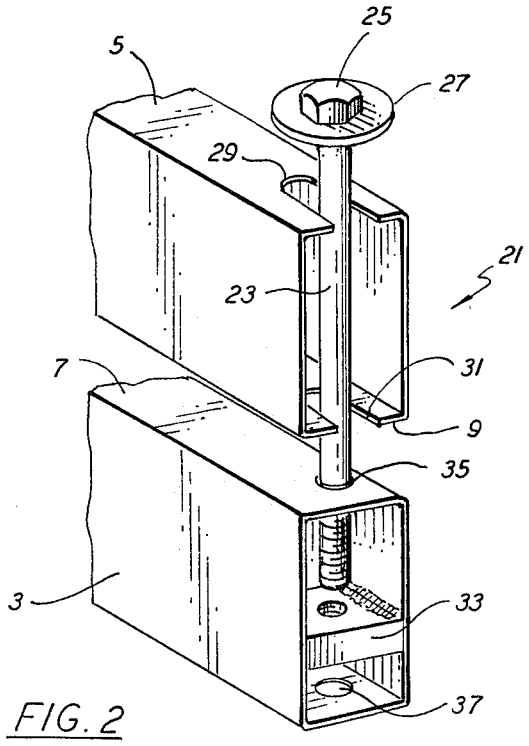
FIG. 2 is a perspective view of an embodiment of an adjusting means according to the invention.

Proximate each end of jaw members 3 and 5 an adjustment means is provided for adjusting the separation of the jaw means to accommodate varying thicknesses of boards and panels and for retaining the jaw means in position, applying pressure, during gluing. These adjustment means may be identical or different and may function cooperatively or independently. The adjustment means straddle a panel being glued, i.e., one adjustment means lies along each edge of a panel so as not to interfere with the panel during gluing. In FIG. 2, a detailed view of an embodiment of an adjustment means designated 21 is shown. (Like elements are given the same reference numbers in the figures.) The embodiment includes a partially threaded rod 23 having a head 25. The combination may be a common bolt. A washer 27 is slipped over rod 23 to provide a larger mutual bearing surface for head 25 and jaw member 5. Jaw member 5 has coaxial apertures 29 and 31 through which rod 23 may pass for engagement with jaw member 3. Jaw member 3 includes a nut means for engaging rod 23. The embodiment of the nut means shown in FIG. 2 is a metal block 33 welded inside jaw member 3. Block 33 has a central, threaded hole for securing and engaging the threads on rod 23. Jaw member 3 also contains apertures 35 and 37, coaxial with the threaded hole in block 33, for passing rod 23. Apertures 29, 31, 35 and 37 are all alignable, being aligned in the assembled clamp so that the boards in the clamp may be compressed by the threading of rod 23 in block 33. When rod 23 is threaded into block 33, washer 27 is drawn toward and engages jaw member 5, causing the jaw members to be drawn together. In the preferred embodiment, block 33 may be a common nut or a specially prepared, tapped metal block welded to the inside walls of jaw member 3.

As shown in FIG. 2, block 33 is preferably offset from the central longitudinal axis of jaw member 3. The offset allows the clamp to accommodate two different ranges of board thicknesses. As shown in FIG. 2, with block 33 spaced on the opposite side of the central longitudinal axis of jaw member 3 from the clamped boards, relatively thin boards can be accommodated between tightly closed jaw members 3 and 5. By rotating jaw member 3 180° about its central longitudinal axis, and engaging rod 23 in block 33, thicker boards can be accommodated. In the latter configuration, block 33 lies on the same side of the longitudinal axis of jaw member 3 and is closer to the jaws 7 and 9. For the thicker board configuration, rod 23 passes through aperture 37 in jaw member 3 to engage block 33. By using a fully threaded rod 23 or by using rods of different lengths in place of rod 23, additional thickness accommodation ranges can be achieved. However, it is desired that when the clamp is tightened, that the threaded portion of rod 23 not protrude from jaw member 3 so that the clamp is not pushed up from the surface on which it is resting.

As one skilled in the art will recognize, the preferred embodiment is but one of way of constructing a nut means. So long as the jaw members are tubular, a nut means may be constructed by welding a threaded metal block within it. A nut means may be constructed in a solid jaw member simply by drilling and tapping the member. By tapping only a portion of a solid jaw member, and offsetting that threaded portion from the central longitudinal axis of the member, the same variable board thickness feature shown in FIG. 2 may be achieved. Numerous other configurations will occur to one skilled in art.

Figure 3:
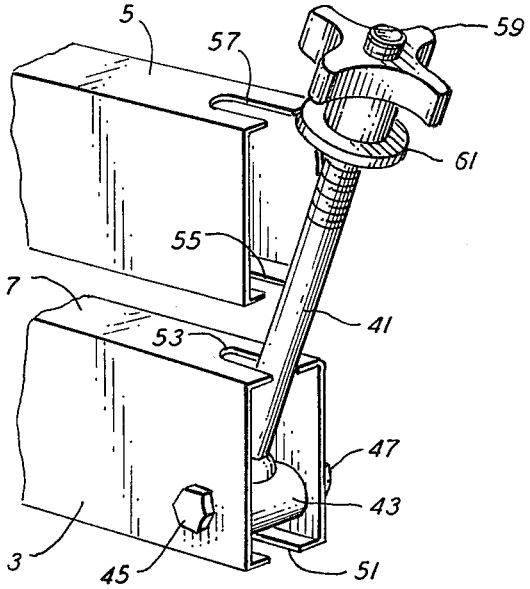
FIG. 3 is a perspective view of an embodiment of an adjusting means and a quick release means according to the invention.

FIG. 3 shows an embodiment of an adjustment means at the second end of the preferred embodiment of a panel clamp. The depicted adjustment means embodiment includes a quick release means. A rod 41 is hingedly attached to the inside of jaw member 3. The hinge, which has an axis of rotation generally normal to the longitudinal axis of jaw member 3, is formed by joining rod 41, preferably by welding, to a tubular cylinder 43 which fits snugly within jaw member 3. The hinge pin is supplied by a bolt 45 which passes through cylinder 43 and coaxial holes (not visible) in jaw member 3. Bolt 45 is prevented from being withdrawn from jaw member 3 by its head 47 on one side of the jaw member and by a locking nut 49 (visible in FIG. 5) on the outside of the opposing side of jaw member 3. Jaw member 3 contains coaxial notches 51 and 53 which open to the ends of member 3 and allow rod 41 to be rotated through 180° so that it may be normal to jaw 7 or its opposing surface. Similarly, jaw member 5 contains coaxial notches 55 and 57 for accommodating rod 41. At its unhinged end, rod 41 is threaded and a threaded handle 59 engages the threads of rod 41. A washer 61 is slipped over rod 41 adjacent to handle 59 to provide a larger mutual bearing surface for handle 59 and jaw member 5. To lock the quick release means, rod 41 is pivoted so that it passes through notches 55 and 57 and washer 61 bears on jaw member 5. Handle 59 is then tightened to compress and to align, in lateral registration, the boards between the jaw members.

As with the nut means, the axis of hinge cylinder 43 is offset from the central longitudinal axis of jaw member 3 to accommodate boards of different thicknesses. When the clamp is locked with rod 41 passing through notch 53 in jaw member 3, the hinge axis of cylinder 43 lies on the opposite side of the longitudinal axis of jaw member 3 from the boards being clamped. Therefore, in this assembly, relatively thin boards may be accommodated by the clamp. When rod 41 is rotated about the hinge so that it passes through notch 51, and jaw member 5 attached in the manner described above, the hinge axis lies on the same side of the central longitudinal axis of jaw member 3 as do the boards being clamped. In this configuration, the clamp may accommodate relatively thick boards. The capacity in both positions is determined by the length of rod 41, the portion of rod 41 which is threaded, the amount of the offset of the hinge axis from the central longitudinal axis of the jaw members and the dimensions of jaw members 3 and 5.

Figure 4:
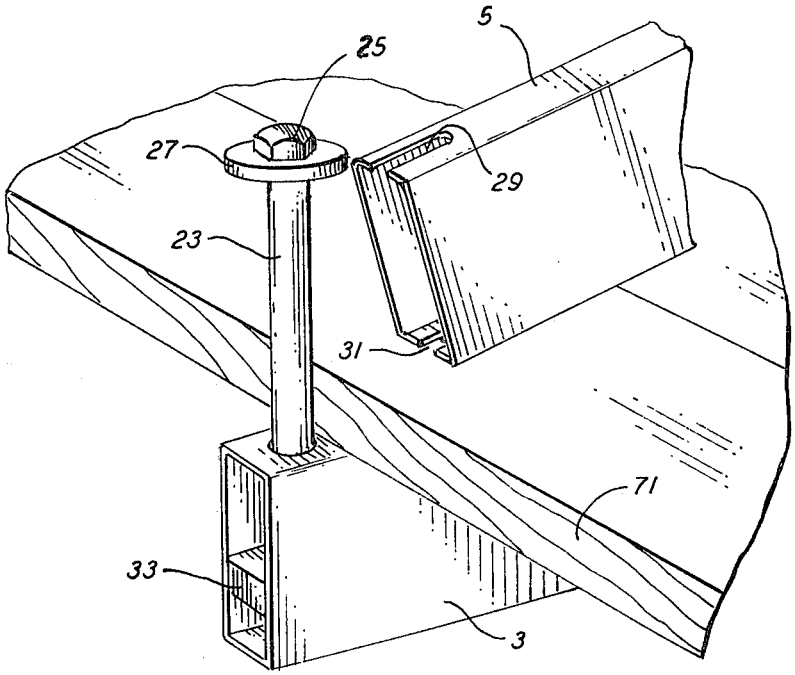
FIG. 4 is a perspective view of a quick release means according to the invention.

A particular advantage of the embodiment of the adjustment means of FIG. 3 is its use as a quick release means for quickly assembling and releasing the jaw means before and after use of the clamp, respectively. The quick release means includes apertures 29 and 31 in the first end of jaw member 5, that is, in the end opposite the end shown in FIG. 3. In FIG. 3, the second ends of jaw members 3 and 5 are shown. Preferably, apertures 29 and 31 are notches open to the first end of jaw member 5 so that jaw member 5 can engage rod 23 by sliding around the rod, rather than by inserting the rod into isolated apertures. With this embodiment of the quick release means, the jaw member, preferably jaw member 3, which will support the boards to be clamped, is placed on a surface, independent of the other jaw member. As shown in FIG. 4, the boards 71 to be clamped are placed on jaw member 3. Then, jaw member 5 is attached, as shown in FIG. 4, by slipping apertures 29 and 31 around rod 23 which has already been engaged in the nut means. The second end is engaged and adjusted by aligning jaw members 3 and 5, swinging rod 41 on its hinge to engage apertures 55 and 57 and tightening handle 59 to compress the boards between the jaw members as desired. Preferably, the length of rod 23 which engages the nut means is preset so that jaw surfaces 7 and 9 will be at the desired separation for the width of the boards being clamped, when the first end of jaw member 5 engages rod 23. The reverse of the assembly procedure just described is used to disassemble the clamp when the boards have been glued. The quick release means aids the woodworker by allowing the jaw members to be separated, eliminating any need for inserting glue-bearing boards through narrow jaw openings.

As is obvious to one skilled in the art, the embodiment of the adjustment means used at each end of the jaw members may be the same. Each may include a quick release means such as the embodiment shown in FIG. 3. However, for reasons of economy, I prefer that the first ends of the jaw members be constructed as shown in FIG. 2 and the second ends be constructed as shown in FIG. 3.

Figure 5:
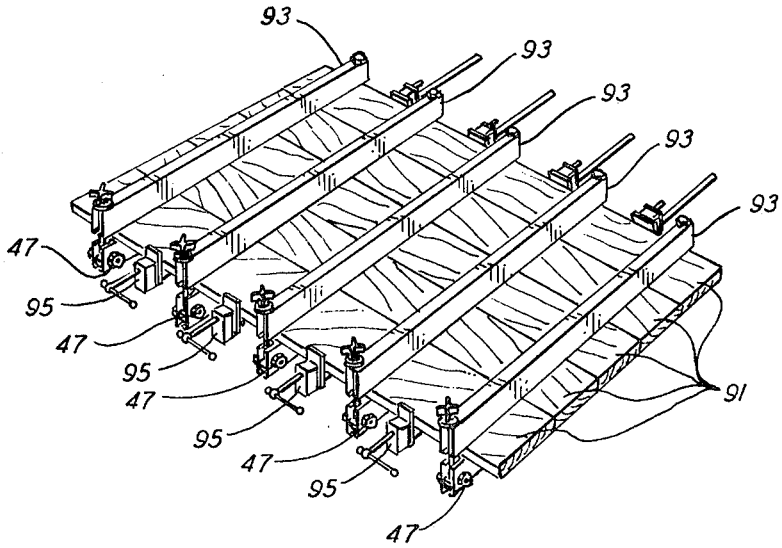
FIG. 5 is a perspective view of a use of an embodiment of the panel clamp according to the invention.

In FIG. 5, a typical use of the panel clamp along with conventional pipe clamps is shown. I prefer to use a number of panel clamps as depicted. The jaw members of the panel clamps are separated and the non-hinged adjusting means are adjusted for the thickness of the boards to be used. Then jaw members containing the adjusted adjusting means are then set up generally parallel to each other. As shown in FIG. 5, five boards 91, which have been previously planed on all sides and glued along their transverse edges, are placed, in edge-to-edge contact on the panel clamp jaw members. Panel clamps 93 are then assembled as previously described and tightened as necessary. I have found that hand tightening of the panel clamps is sufficient to achieve the desired result. Pipe clamps 95 are then applied in a conventional manner. Panel clamps 93 do not prevent the boards from being drawn together by pipe clamps 95 for achieving good glue bonds, but they do prevent boards 91 from buckling or bowing under the load produced by pipe clamps 95. When the glue has set, all clamps are disassembled and a panel free of warping and buckling is removed. As is obvious from the drawings, the width capacity of a clamp is determined by the size and separation of the adjusting means at the ends of the jaw members since the adjusting means straddle the width of a panel. Panel clamps can be made of various length jaw members to accommodate various panel widths.

The invention has been described with reference to a preferred embodiment. One skilled in the art will recognize various changes, substitutions and additions which may be made without departing from the spirit of the invention. Therefore, the scope of the invention is limited solely by the following claims.

I claim:

1. A clamp preventing warping of a panel formed from edge-glued boards, during gluing of said boards, said clamp comprising:

first and second opposing jaw means for maintaining boards in lateral registration, each jaw means being tubular and having a central longitudinal axis and opposing first and second ends, said respective first and second ends of said first and second jaw means opposing each other, respectively;

adjustment means, proximate each of said respective opposed first and second ends of said jaw means, for engaging said jaw means, adjusting the separation of said jaw means and retaining said jaw means in position during use, said adjustment means comprising first threaded nut means for engaging a threaded article, said nut means being disposed within and being attached to said first jaw member offset from said axis proximate said first end of said first jaw member, a threaded rod for engaging said first nut means, said rod having a head, and said second jaw member includes, proximate its first end, an aperture for receiving said rod to engage said head and said second jaw member.

2. The invention of claim 1 further including quick release means, for quickly assembling and releasing said jaw means before and after use of said clamp, respectively.

3. The invention of claim 1 wherein said jaw members are formed from tubing of rectangular cross section and planar surfaces of said jaw members comprise jaws for bearing on said boards.

4. The invention of claim 2 wherein said quick release means comprises a threaded rod hingedly attached to said first jaw member proximate said second end of said first jaw member, second threaded nut means for engaging said rod, and said second jaw member includes, proximate its second end, a first notch open to said second end of said second jaw member, for receiving said rod for engagement of said second nut means and said second jaw member.

5. The invention of claim 4 wherein said second nut means comprises a threaded handle.

6. The invention of claim 4 wherein said quick release means further comprises said aperture and wherein said aperture is a second notch open to said first end of said second jaw member.

7. The invention of claim 4 wherein the hinge axis of said hingedly attached rod is offset from said longitudinal axis of said first jaw member.

* * * * *